US010058746B1

(12) United States Patent
Peng

(10) Patent No.: US 10,058,746 B1
(45) Date of Patent: Aug. 28, 2018

(54) MANUFACTURING METHOD OF GOLF STRIKE PAD AND THE COMPONENTS OF THE GOLF STRIKE PAD MADE BY THE SAME MANUFACTURING METHOD

(71) Applicant: Hung-Tao Peng, Tongluo Shiang, Miaoli County (TW)

(72) Inventor: Hung-Tao Peng, Tongluo Shiang, Miaoli County (TW)

( * ) Notice: Subject to any disclaimer, the term of this patent is extended or adjusted under 35 U.S.C. 154(b) by 0 days.

(21) Appl. No.: 15/497,531

(22) Filed: Apr. 26, 2017

(51) Int. Cl.

| | |
|---|---|
| ***A63B 53/04*** | (2015.01) |
| ***B22D 19/14*** | (2006.01) |
| ***B22D 19/02*** | (2006.01) |
| ***B22D 21/00*** | (2006.01) |

(52) U.S. Cl.
CPC ..... *A63B 53/0466* (2013.01); *B22D 19/02* (2013.01); *B22D 19/14* (2013.01); *B22D 21/007* (2013.01); *A63B 2053/042* (2013.01)

(58) Field of Classification Search
CPC ..... A63B 53/0466; A63B 2053/042; B22D 19/02; B22D 19/14
See application file for complete search history.

(56) References Cited

U.S. PATENT DOCUMENTS

| | | | | |
|---|---|---|---|---|
| 5,199,481 | A * | 4/1993 | Corwin | B22D 19/14 164/103 |
| 6,591,892 | B1 * | 7/2003 | Moore | B22D 19/14 106/481 |
| 2008/0029496 | A1 * | 2/2008 | Lin | A63B 53/0466 219/121.64 |
| 2009/0075056 | A1 * | 3/2009 | Iwamoto | B22D 19/14 428/319.1 |
| 2010/0050409 | A1 * | 3/2010 | Liang | A63B 53/0466 29/412 |
| 2010/0234132 | A1 * | 9/2010 | Hirsch | A63B 53/04 473/340 |

* cited by examiner

*Primary Examiner* — Michael Dennis
(74) *Attorney, Agent, or Firm* — Egbert Law Offices, PLLC

(57) ABSTRACT

A manufacturing method of golf strike pad includes the following steps of shaping an embryonic form of the golf strike pad, solidifying the embryonic form of the golf strike pad, heating the solidified embryonic form of the golf strike pad, positioning the heated embryonic form of the golf strike pad in a mold, casting the melted aluminum-magnesium alloy into the mold, taking the blank of the golf strike pad from the mold and grinding the blank of the golf strike pad for finishing the manufacturing method.

2 Claims, 8 Drawing Sheets

MANUFACTURING METHOD OF GOLF STRIKE PAD AND THE COMPONENTS OF THE GOLF STRIKE PAD MADE BY THE SAME MANUFACTURING METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a manufacturing method, and more particularly to a manufacturing method of a golf strike pad and the components of the golf strike pad made by the same manufacturing method.

2. Description of Related Art Including Information Disclosed Under 37 CFR 1.97 and 37 CFR 1.98

Whatever young and old, golf is a popular kind of outdoor sport. A golf course usually is situated on a hillside such that the player can enjoy fresh air and beautiful scenery. Furthermore, the player can also walk for his/her health without riding a golf cart.

The target of the golf players is to push the ball into the hole using the minimum number of swings. Under the common target, the golf strike pad, directly striking the ball when swung, is continually improved for providing a product having a high hardness and a light weight.

For the purpose for providing a golf strike pad that has a high hardness and a light weight, some manufacturers use the titanium alloy or carbon fiber for replacing the conventional metal material and providing a light weight product. However, the titanium alloy is very expensive. Accordingly, the price of the golf strike pad may be raised such that the expensive golf strike pad cannot be widely used. Secondary, the golf strike pad, made of carbon fiber, is easily broken and unsuitable to a newcomer.

The present invention has arisen to mitigate and/or obviate the disadvantages of the conventional golf strike pads.

BRIEF SUMMARY OF THE INVENTION

The main objective of the present invention is to provide an improved golf strike pad manufacturing method providing a golf strike pad that has a light weight, a high hardness and a low cost.

To achieve the objective, the manufacturing method in accordance with the present invention comprises the following steps.

Shaping: the powders of silicon carbide and sodium silicate are evenly mixed and shaped into an embryonic form of the golf strike pad.

Solidifying: carbon dioxide is provided to a periphery of the embryonic form of the golf strike pad for solidifying the embryonic form of the golf strike pad.

Heating: the solidified embryonic form of the golf strike pad is heated to 1000° C.-1200° C.

Closing mold: the mold is closed after the heated embryonic form of the golf strike pad being positioned in the mold.

Casting: the melted aluminum-magnesium alloy is casted into the mold for combining the powders of silicon carbide and sodium silicate and gradually cooled in the mold.

Opening the mold: the blank of the golf strike pad is taken from the mold after the aluminum-magnesium alloy being cooled.

Grinding: the blank of the golf strike pad is ground to remove the burr of the blank of the golf strike pad.

Further benefits and advantages of the present invention will become apparent after a careful reading of the detailed description with appropriate reference to the accompanying drawings.

DETAILED DESCRIPTION OF THE INVENTION

Figure 1:
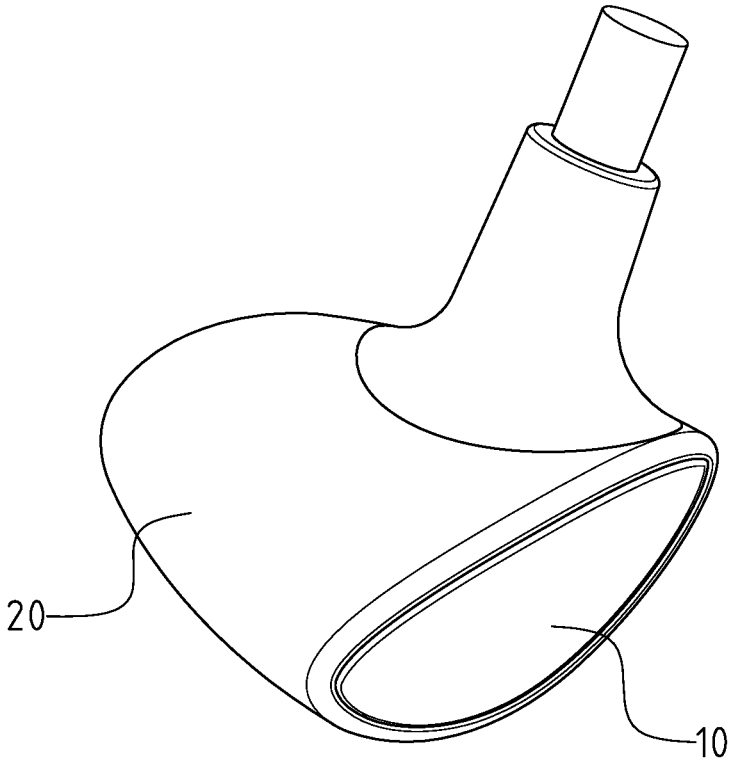
FIG. 1 is a perspective view of a golf club head.
Figure 2:
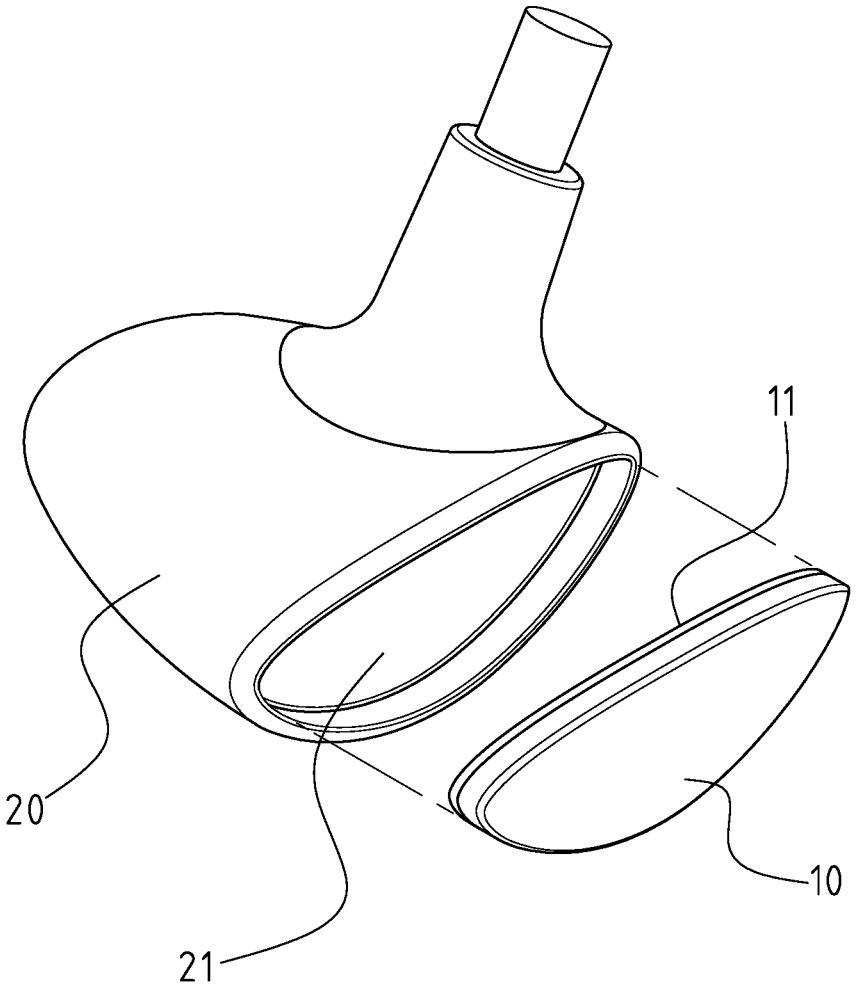
FIG. 2 is an exploded perspective view of the golf club head in FIG. 1.
Figure 3:
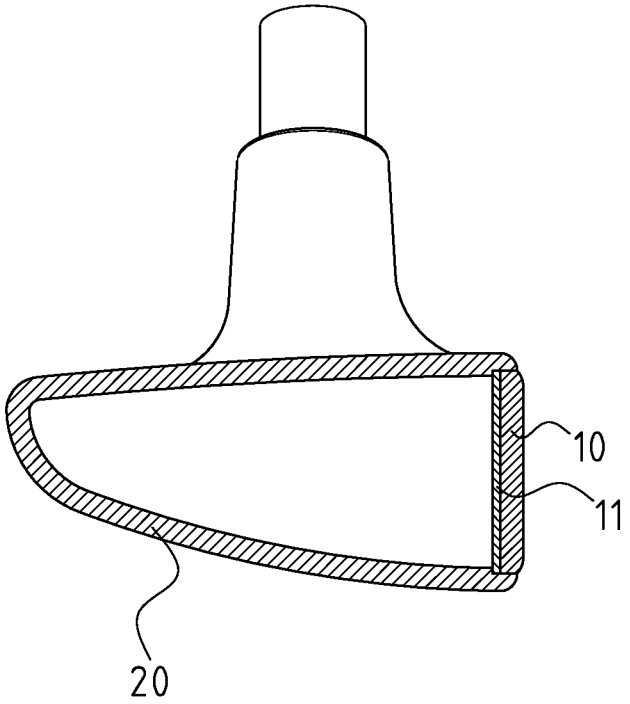
FIG. 3 is a cross-sectional view of the golf club head in FIG. 1.

Referring to the drawings and initially to FIGS. 1, 2, 3 and 4, as usual, a golf club head includes a hollow body 21 formed with an opening 21 and a golf strike pad 10 secured on the hollow body 21 for closing the opening 21. The manufacturing method in accordance with the present invention is provided for manufacturing the golf strike pad 10, as shown in FIGS. 1, 2 and 3. The manufacturing method manufactures the golf strike pad 10 by composite materials containing silicon carbide (SiC), sodium silicate ($Na_2SiO_3$) and aluminum-magnesium alloy for providing a golf strike pad 10 that has a light weight, a high hardness and a low cost.

Figure 5:
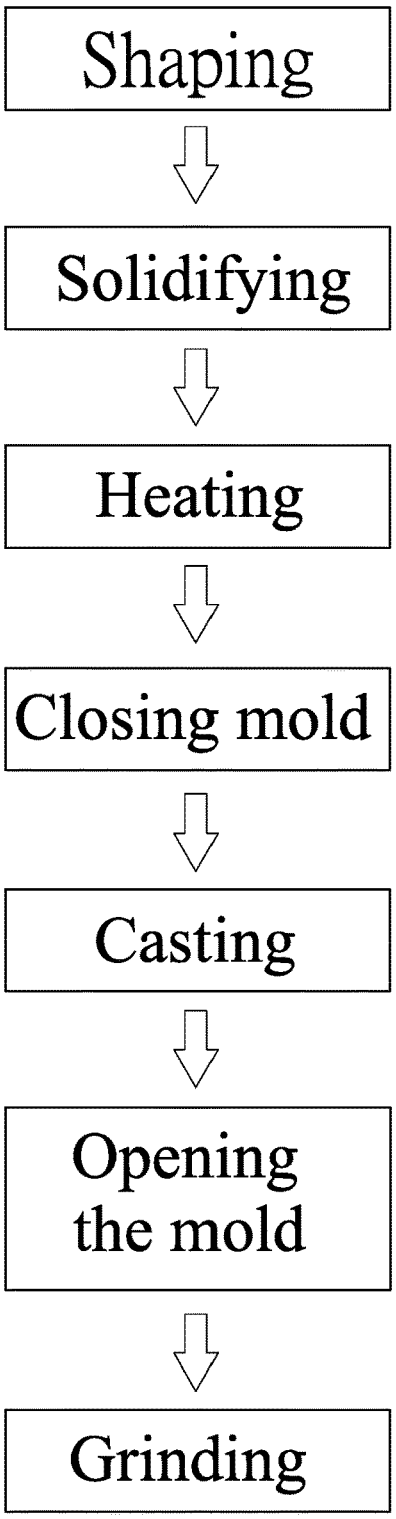
FIG. 5 is a flow chart of a first preferred embodiment on the manufacturing method of golf strike pad in accordance with the present invention.

With reference to FIG. 5 that shows a first preferred embodiment of the manufacturing method of golf strike pad in accordance with the present invention, in this embodiment, the manufacturing method comprises the following steps.

Shaping: the powders of the silicon carbide and the sodium silicate are evenly mixed and shaped into an embryonic form of the golf strike pad 10.

Solidifying: carbon dioxide is provided to a periphery of the embryonic form of the golf strike pad 10 for solidifying the embryonic form of the golf strike pad 10.

Heating: the solidified embryonic form of the golf strike pad 10 is heated to 1000° C.-1200° C.

Closing mold: the mold is closed after the heated embryonic form of the golf strike pad 10 being positioned in the mold.

Casting: the melted aluminum-magnesium alloy is casted into the mold for combining the powders of silicon carbide and sodium silicate and gradually cooled in the mold.

Opening the mold: the blank of the golf strike pad 10 is taken from the mold after the aluminum-magnesium alloy being cooled.

Grinding: the blank of the golf strike pad 10 is ground to remove the burr of the blank of the golf strike pad 10 and provide a golf strike pad 10 that has a light weight, a high hardness and a low cost.

The golf strike pad 10 in accordance with the present invention contains silicon carbide, sodium silicate and aluminum-magnesium alloy. The total volume percentage of the silicon carbide and the sodium silicate is 50% to 68% relative to the golf strike pad 10 and the volume percentage of the aluminum-magnesium alloy is 32% to 50% relative to the golf strike pad 10. The volume percentage of the silicon carbide is 97% to 99% relative to the total volume of the silicon carbide and the sodium silicate. The volume percentage of the sodium silicate is 1% to 3% relative to the total volume of the silicon carbide and the sodium silicate. The volume percentage of the aluminum is 92.5% relative to the aluminum-magnesium alloy and the volume percentage of the magnesium is 0.2% to 2% relative to the aluminum-magnesium alloy. In the preferred embodiment of the present invention, the total volume percentage of the silicon carbide and the sodium silicate is 63% relative to the golf strike pad 10, the volume percentage of the aluminum-magnesium alloy is 37% relative to the golf strike pad 10 and the volume percentage of the magnesium is 0.45% relative to the aluminum-magnesium alloy.

Figure 4:
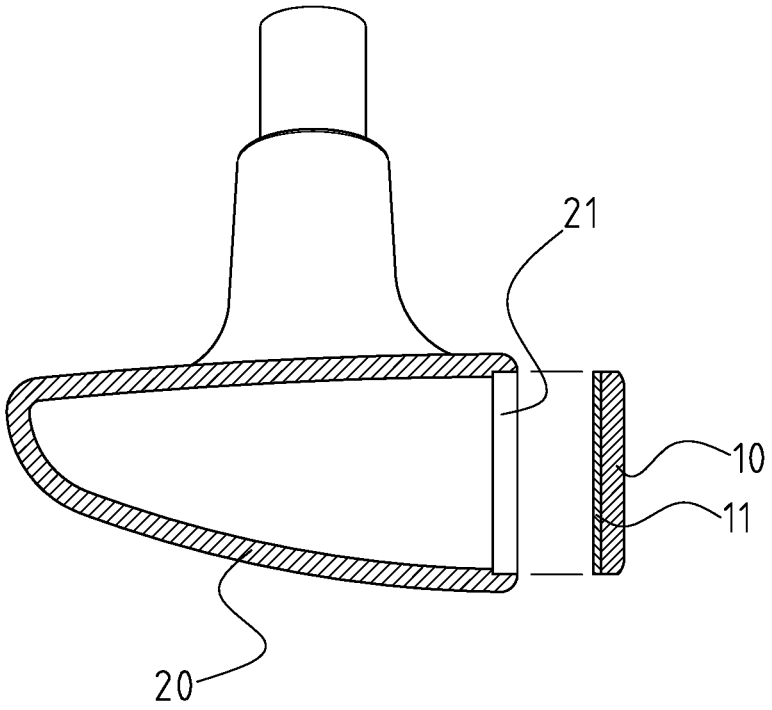
FIG. 4 is an exploded cross-sectional view of the golf club head in FIG. 1.

With reference to FIGS. 3 and 4, a glass fiber layer 11 is securely adhered to a back of the golf strike pad 10 such that the golf strike pad 10 in accordance with the present invention contains the material properties of a laminated glass. As a result, the broken golf strike pad 10 does not cut persons when the golf strike pad 10 is broken due to an improper force.

Figure 6:
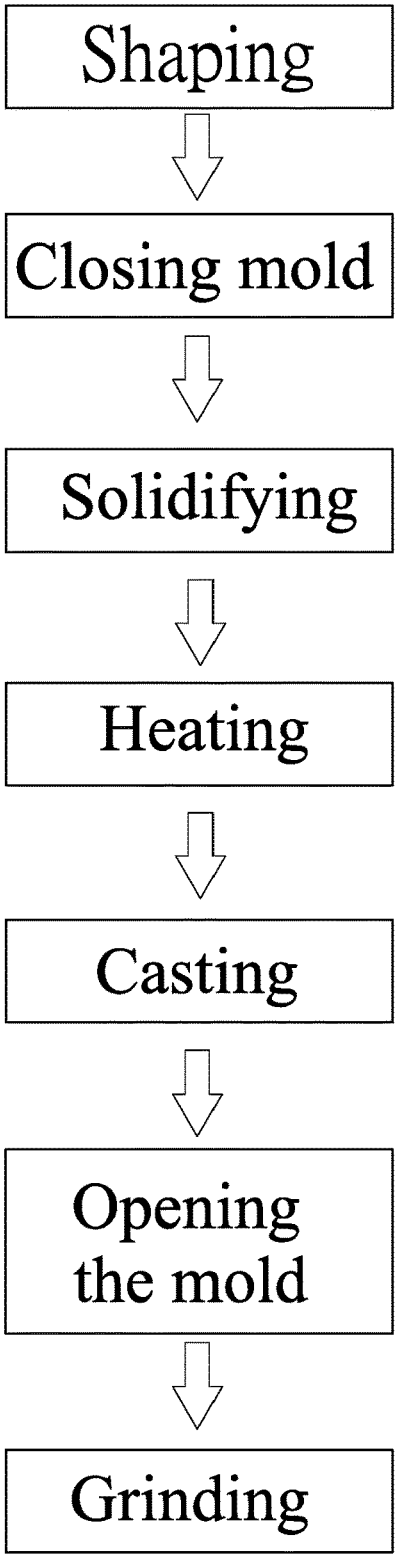
FIG. 6 is a flow chart of a second preferred embodiment on the manufacturing method of golf strike pad in accordance with the present invention.

With reference to FIG. 6 that shows a second preferred embodiment of the manufacturing method of golf strike pad in accordance with the present invention, in this embodiment, the manufacturing method comprises the following steps.

Shaping: the powders of the silicon carbide and the sodium silicate are evenly mixed and shaped into an embryonic form of the golf strike pad 10.

Closing mold: the mold is closed after the embryonic form of the golf strike pad 10 being positioned in the mold.

Solidifying: carbon dioxide is provided into the mold for solidifying the embryonic form of the golf strike pad 10.

Heating: the solidified embryonic form of the golf strike pad 10 is heated to 1000° C.-1200° C.

Casting: the melted aluminum-magnesium alloy is casted into the mold for combining the powders of silicon carbide and sodium silicate and gradually cooled in the mold.

Opening the mold: the blank of the golf strike pad 10 is taken from the mold after the aluminum-magnesium alloy being cooled.

Grinding: the blank of the golf strike pad 10 is ground to remove the burr of the blank of the golf strike pad 10 and provide a golf strike pad 10 that has a light weight, a high hardness and a low cost. Similarly, a glass fiber layer 11 is securely adhered to a back of the golf strike pad 10.

In this embodiment, the manufacturing processes are simplified. In addition, the carbon dioxide is directly provided into the mold such that the usage amount of the carbon dioxide is greatly reduced.

Figure 7:
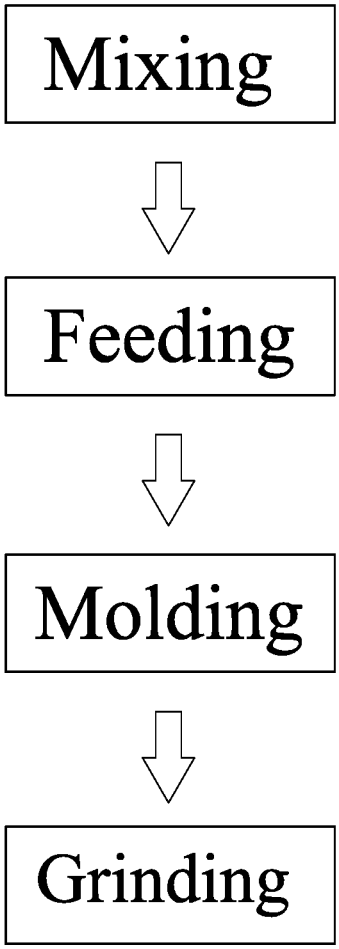
FIG. 7 is a flow chart of a third preferred embodiment on the manufacturing method of golf strike pad in accordance with the present invention.

With reference to FIG. 7 that shows a third preferred embodiment of the manufacturing method of golf strike pad in accordance with the present invention, in this embodiment, the manufacturing method comprises the following steps.

Mixing: the powders of the aluminum-magnesium alloy and the silicon carbide, and the liquid sodium silicate are evenly fully mixed.

Feeding: the well mixed powders of the aluminum-magnesium alloy and the silicon carbide, and the liquid sodium silicate are provided into a mold.

Molding: the well mixed powders of the aluminum-magnesium alloy and the silicon carbide, and the liquid sodium silicate are directly shaped in the mold by high temperature and high pressure.

Grinding: the blank of the golf strike pad 10 is ground to remove the burr of the blank of the golf strike pad 10 and provide a golf strike pad 10 that has a light weight, a high hardness and a low cost. Similarly, a glass fiber layer 11 is securely adhered to a back of the golf strike pad 10.

Figure 8:
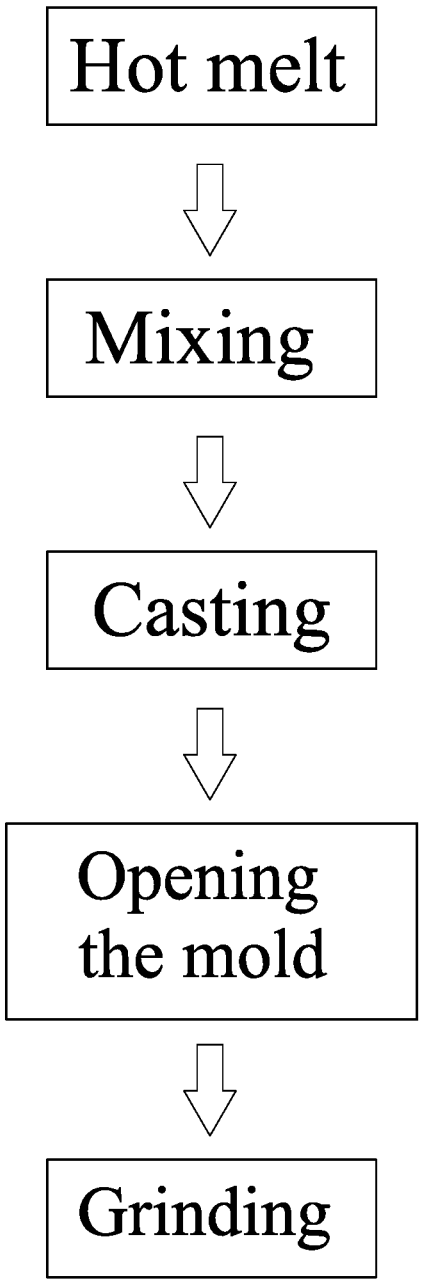
FIG. 8 is a flow chart of a fourth preferred embodiment on the manufacturing method of golf strike pad in accordance with the present invention.

With reference to FIG. 8 that shows a fourth preferred embodiment of the manufacturing method of golf strike pad in accordance with the present invention, in this embodiment, the manufacturing method comprises the following steps.

Hot melt: the aluminum-magnesium alloy is heated and melted.

Mixing: the powders of the silicon carbide and the sodium silicate are evenly mixed according to the ratio disclosed in the first preferred embodiment and added into the hot melted aluminum-magnesium alloy.

Casting: the hot melted aluminum-magnesium alloy, containing the powders of the silicon carbide and the sodium silicate, is casted into a mold.

Open the mold: the mold is opened and the blank of the golf strike pad 10 is taken out from the mold after the shaped aluminum-magnesium alloy being cooled.

Grinding: the blank of the golf strike pad 10 is ground to remove the burr of the blank of the golf strike pad 10 and provide a golf strike pad 10 that has a light weight, a high hardness and a low cost. Similarly, a glass fiber layer 11 is securely adhered to a back of the golf strike pad 10.

Furthermore, the golf strike pad 10 in accordance with the present invention also can be manufactured by powder metallurgy or die-casting. The powders of the silicon carbide and the sodium silicate are used to increase the contract area among the powders of the silicon carbide and the sodium silicate, and the aluminum-magnesium alloy. The diameter of the powders of the silicon carbide and the sodium silicate is more smaller, the bonding strength among the powders of the silicon carbide and the sodium silicate, and the aluminum-magnesium alloy is more stronger.

The aluminum-magnesium alloy containing the silicon carbide and the sodium silicate has an excellent heat dissipation effect such that it is usually provided for high-level radiator that is the reason why the golf strike pad 10 in accordance with the present invention is made of aluminum-magnesium alloy that contains the silicon carbide and the sodium silicate. The golf strike pad is inwardly deformed and immediately causes high heat energy. The golf strike pad 10 made of aluminum-magnesium alloy containing the silicon carbide and the sodium silicate can quickly release the high heat energy during striking the golf ball and reduce the metal fatigue level for extending the use life of the golf strike pad 10.

Although the invention has been explained in relation to its preferred embodiment, it is to be understood that many other possible modifications and variations can be made without departing from the spirit and scope of the invention as hereinafter claimed.

I claim:

1. A method of manufacturing a golf strike pad, the method comprising:

mixing powders of an aluminum-magnesium alloy and a silicon carbide and a liquid sodium silicate;

feeding the mixed powders of the aluminum-magnesium alloy and the silicon carbide and the liquid sodium silicate into a mold;

molding the fed mixed powders of the aluminum-magnesium alloy and the silicon carbide and the liquid sodium silicate into a blank shape of the golf strike pad in the mold by high temperature and high pressure; and grinding the blank shape of the golf strike pad to remove a burr of the blank shape of the golf strike pad.

2. The of claim 1, further comprising:

securely adhering a glass fiber layer to a back of the golf strike pad.

* * * * *